US006885273B2

(12) United States Patent
Min et al.

(10) Patent No.: US 6,885,273 B2
(45) Date of Patent: Apr. 26, 2005

(54) INDUCTION DEVICES WITH DISTRIBUTED AIR GAPS

(75) Inventors: Pan Min, Uppsala (SE); Li Ming, Västerås (SE); Rongsheng Liu, Västerås (SE); Mikael Dahlgren, Västerås (SE); Par Holmberg, Västerås (SE); Gunnar Russberg, Västerås (SE); Christian Sasse, Västerås (SE); Svante Söderholm, Västerås (SE)

(73) Assignee: ABB AB, Vasteras (SE)

( * ) Notice: Subject to any disclaimer, the term of this patent is extended or adjusted under 35 U.S.C. 154(b) by 42 days.

(21) Appl. No.: 10/073,866

(22) Filed: Feb. 14, 2002

(65) Prior Publication Data

US 2003/0030529 A1 Feb. 13, 2003

Related U.S. Application Data

(63) Continuation of application No. 09/537,748, filed on Mar. 30, 2000, now abandoned.

(51) Int. Cl.[7] ..... H01F 17/06
(52) U.S. Cl. ..... 336/178
(58) Field of Search ..... 336/83, 178, 212, 336/220, 221, 233, 234

(56) References Cited

U.S. PATENT DOCUMENTS

| | | | |
|---|---|---|---|
| 681,800 | A | 9/1901 | Lasche |
| 847,008 | A | 3/1907 | Kitsee |
| 1,304,451 | A | 5/1919 | Burnham |
| 1,418,856 | A | 6/1922 | Williamson |
| 1,481,585 | A | 1/1924 | Beard |
| 1,508,456 | A | 9/1924 | Lexz |
| 1,728,915 | A | 9/1929 | Blankenship et al. |

(Continued)

FOREIGN PATENT DOCUMENTS

| | | |
|---|---|---|
| AT | 399790 | 7/1995 |
| BE | 565063 | 2/1957 |
| CH | 391071 | 4/1965 |
| CH | 266037 | 10/1965 |
| CH | 534448 | 2/1973 |
| CH | 539328 | 7/1973 |
| CH | 646403 | 2/1979 |

(Continued)

OTHER PUBLICATIONS

A test installation of a self–tuned ac filter in the Konti–Skan 2 HVDC link; T. Holmgren,G. Asplund, S. Valdemarsson, P. Hidman of ABB; U. Jonsson of Svenska Kraftnat; O. loof of Vattenfall Vastsverige AB; IEEE Stockholm Power Tech Conference Jun. 1995, pp 64–70.

Analysis of faulted Power Systems; P Anderson, Iowa State University Press / Ames, Iowa, 1973, pp 255–257, no month.

36–Kv. Generators Arise from Insulation Research; P. Sidler; *Electrical World* Oct. 15, 1932, ppp 524.

Oil Water cooled 300 MW turbine generator;L.P. Gnedin et al;*Elekrotechnika* , 1970, pp 6–8, no month.

J&P Transformer Book 11$^{th}$ Edition;A. C. Franklin et al; owned by Butterworth–Heinemann Ltd, Oxford Printed by Hartnolls Ltd in Great Britain 1983, pp29–67, no month.

Transformerboard: H.P. Moser et al; 1979, pp 1–19, no month.

(Continued)

*Primary Examiner*—Tuyen T. Nguyen
(74) *Attorney, Agent, or Firm*—Dykema Gossett PLLC

(57) ABSTRACT

A distributed air gap material for a induction device in power systems for minimizing fringe losses, mechanical losses and noise in the core The distributed air gap material occupies a selected portion of the core and is formed of a finely divided magnetic material in a matrix of a dielectric material particles. The air gap material has a zone of transition in which the permeability values vary within the air gap material.

7 Claims, 7 Drawing Sheets

U.S. PATENT DOCUMENTS

| | | | |
|---|---|---|---|
| 1,742,985 | A | 1/1930 | Burnham |
| 1,747,507 | A | 2/1930 | George |
| 1,756,672 | A | 4/1930 | Barr |
| 1,762,775 | A | 6/1930 | Ganz |
| 1,781,308 | A | 11/1930 | Vos |
| 1,861,182 | A | 5/1932 | Hendey et al. |
| 1,904,885 | A | 4/1933 | Seeley |
| 1,974,406 | A | 9/1934 | Apple et al. |
| 2,006,170 | A | 6/1935 | Juhlin |
| 2,206,856 | A | 7/1940 | Shearer |
| 2,217,430 | A | 10/1940 | Baudry |
| 2,241,832 | A | 5/1941 | Wahlquist |
| 2,251,291 | A | 8/1941 | Reichelt |
| 2,256,897 | A | 9/1941 | Davidson et al. |
| 2,295,415 | A | 9/1942 | Monroe |
| 2,409,893 | A | 10/1946 | Pendleton et al. |
| 2,415,652 | A | 2/1947 | Norton |
| 2,424,443 | A | 7/1947 | Evans |
| 2,436,306 | A | 2/1948 | Johnson |
| 2,446,999 | A | 8/1948 | Camilli |
| 2,459,322 | A | 1/1949 | Johnston |
| 2,462,651 | A | 2/1949 | Lord |
| 2,498,238 | A | 2/1950 | Berberich et al. |
| 2,650,350 | A | 8/1953 | Heath |
| 2,721,905 | A | 10/1955 | Monroe |
| 2,749,456 | A | 6/1956 | Luenberger |
| 2,780,771 | A | 2/1957 | Lee |
| 2,846,599 | A | 8/1958 | McAdam |
| 2,885,581 | A | 5/1959 | Pileggi |
| 2,943,242 | A | 6/1960 | Schaschl et al. |
| 2,947,957 | A | 8/1960 | Spindler |
| 2,959,699 | A | 11/1960 | Smith et al. |
| 2,962,679 | A | 11/1960 | Stratton |
| 2,975,309 | A | 3/1961 | Seidner |
| 3,014,139 | A | 12/1961 | Shildneck |
| 3,098,893 | A | 7/1963 | Pringle et al. |
| 3,130,335 | A | 4/1964 | Rejda |
| 3,143,269 | A | 8/1964 | Eldik |
| 3,157,806 | A | 11/1964 | Wiedemann |
| 3,158,770 | A | 11/1964 | Coggeshall et al. |
| 3,197,723 | A | 7/1965 | Dortort |
| 3,268,766 | A | 8/1966 | Amos |
| 3,304,599 | A | 2/1967 | Nordin |
| 3,354,331 | A | 11/1967 | Broeker et al. |
| 3,365,657 | A | 1/1968 | Webb |
| 3,372,283 | A | 3/1968 | Jaecklin |
| 3,392,779 | A | 7/1968 | Tilbrook |
| 3,411,027 | A | 11/1968 | Rosenberg |
| 3,418,530 | A | 12/1968 | Cheever |
| 3,435,262 | A | 3/1969 | Bennett et al. |
| 3,437,858 | A | 4/1969 | White |
| 3,444,407 | A | 5/1969 | Yates |
| 3,447,002 | A | 5/1969 | Ronnevig |
| 3,484,690 | A | 12/1969 | Wald |
| 3,541,221 | A | 11/1970 | Aupoix et al. |
| 3,560,777 | A | 2/1971 | Moeller |
| 3,571,690 | A | 3/1971 | Lataisa |
| 3,593,123 | A | 7/1971 | Williamson |
| 3,631,519 | A | 12/1971 | Salahshourian |
| 3,644,662 | A | 2/1972 | Salahshourian |
| 3,651,244 | A | 3/1972 | Silver et al. |
| 3,651,402 | A | 3/1972 | Leffmann |
| 3,660,721 | A | 5/1972 | Baird |
| 3,666,876 | A | 5/1972 | Forster |
| 3,670,192 | A | 6/1972 | Andersson et al. |
| 3,675,056 | A | 7/1972 | Lenz |
| 3,684,821 | A | 8/1972 | Miyauchi et al. |
| 3,684,906 | A | 8/1972 | Lexz |
| 3,699,238 | A | 10/1972 | Hansen et al. |
| 3,716,652 | A | 2/1973 | Lusk et al. |
| 3,716,719 | A | 2/1973 | Angelery et al. |
| 3,727,085 | A | 4/1973 | Goetz et al. |
| 3,740,600 | A | 6/1973 | Turley |
| 3,743,867 | A | 7/1973 | Smith, Jr. |
| 3,746,954 | A | 7/1973 | Myles et al. |
| 3,758,699 | A | 9/1973 | Lusk et al. |
| 3,778,891 | A | 12/1973 | Amasino et al. |
| 3,781,739 | A | 12/1973 | Meyer |
| 3,787,607 | A | 1/1974 | Schlafly |
| 3,792,399 | A | 2/1974 | McLyman |
| 3,801,843 | A | 4/1974 | Corman et al. |
| 3,809,933 | A | 5/1974 | Sugawara et al. |
| 3,813,764 | A | 6/1974 | Tanaka et al. |
| 3,828,115 | A | 8/1974 | Hvizd, Jr. |
| 3,881,647 | A | 5/1975 | Wolfe |
| 3,884,154 | A | 5/1975 | Marten |
| 3,891,880 | A | 6/1975 | Britsch |
| 3,902,000 | A | 8/1975 | Forsyth et al. |
| 3,912,957 | A | 10/1975 | Reynolds |
| 3,932,779 | A | 1/1976 | Madsen |
| 3,932,791 | A | 1/1976 | Oswald |
| 3,943,392 | A | 3/1976 | Keuper et al. |
| 3,947,278 | A | 3/1976 | Youtsey |
| 3,965,408 | A | 6/1976 | Higuchi et al. |
| 3,968,388 | A | 7/1976 | Lambrecht et al. |
| 3,971,543 | A | 7/1976 | Shanahan |
| 3,974,314 | A | 8/1976 | Fuchs |
| 3,993,860 | A | 11/1976 | Snow et al. |
| 3,995,785 | A | 12/1976 | Arick et al. |
| 4,001,616 | A | 1/1977 | Lonseth et al. |
| 4,008,367 | A | 2/1977 | Sunderhauf |
| 4,008,409 | A | 2/1977 | Rhudy et al. |
| 4,031,310 | A | 6/1977 | Jachimowicz |
| 4,039,740 | A | 8/1977 | Iwata |
| 4,041,431 | A | 8/1977 | Enoksen |
| 4,047,138 | A | 9/1977 | Steigerwald |
| 4,064,419 | A | 12/1977 | Peterson |
| 4,084,307 | A | 4/1978 | Schultz et al. |
| 4,085,347 | A | 4/1978 | Lichius |
| 4,088,953 | A | 5/1978 | Sarian |
| 4,091,138 | A | 5/1978 | Takagi et al. |
| 4,091,139 | A | 5/1978 | Quirk |
| 4,099,227 | A | 7/1978 | Liptak |
| 4,103,075 | A | 7/1978 | Adam |
| 4,106,069 | A | 8/1978 | Trautner et al. |
| 4,107,092 | A | 8/1978 | Carnahan et al. |
| 4,109,098 | A | 8/1978 | Olsson et al. |
| 4,121,148 | A | 10/1978 | Platzer |
| 4,132,914 | A | 1/1979 | Khutoretsky |
| 4,134,036 | A | 1/1979 | Curtiss |
| 4,134,055 | A | 1/1979 | Akamatsu |
| 4,134,146 | A | 1/1979 | Stetson |
| 4,149,101 | A | 4/1979 | Lesokhin et al. |
| 4,152,615 | A | 5/1979 | Calfo et al. |
| 4,160,193 | A | 7/1979 | Richmond |
| 4,164,672 | A | 8/1979 | Flick |
| 4,164,772 | A | 8/1979 | Hingorani |
| 4,177,397 | A | 12/1979 | Lill |
| 4,177,418 | A | 12/1979 | Brueckner et al. |
| 4,184,186 | A | 1/1980 | Barkan |
| 4,200,817 | A | 4/1980 | Bratoljic |
| 4,200,818 | A | 4/1980 | Ruffing et al. |
| 4,206,434 | A | 6/1980 | Hase |
| 4,207,427 | A | 6/1980 | Beretta et al. |
| 4,207,482 | A | 6/1980 | Neumeyer et al. |
| 4,208,597 | A | 6/1980 | Mulach et al. |
| 4,229,721 | A | 10/1980 | Koloczek et al. |
| 4,238,339 | A | 12/1980 | Khutoretsky et al. |
| 4,239,999 | A | 12/1980 | Vinokurov et al. |
| 4,245,182 | A | 1/1981 | Aotsu et al. |
| 4,246,694 | A | 1/1981 | Raschbichler et al. |

4,255,684 A 3/1981 Mischler et al.
4,258,280 A 3/1981 Starcevic
4,262,209 A 4/1981 Berner
4,274,027 A 6/1981 Higuchi et al.
4,281,264 A 7/1981 Keim et al.
4,307,311 A 12/1981 Grozinger
4,308,476 A 12/1981 Schuler
4,308,575 A 12/1981 Mase
4,310,966 A 1/1982 Breitenbach
4,314,168 A 2/1982 Breitenbach
4,317,001 A 2/1982 Silver et al.
4,320,645 A 3/1982 Stanley
4,321,426 A 3/1982 Schaeffer
4,321,518 A 3/1982 Akamatsu
4,330,726 A 5/1982 Albright et al.
4,337,922 A 7/1982 Streiff et al.
4,341,989 A 7/1982 Sandberg et al.
4,347,449 A 8/1982 Beau
4,347,454 A 8/1982 Gellert et al.
4,357,542 A 11/1982 Kirschbaum
4,360,748 A 11/1982 Raschbichler et al.
4,361,723 A 11/1982 Hvizd, Jr. et al.
4,363,612 A 12/1982 Meyers
4,365,178 A 12/1982 Lenz
4,367,425 A 1/1983 Mendelsohn et al.
4,367,890 A 1/1983 Spirk
4,368,418 A 1/1983 Demello et al.
4,369,389 A 1/1983 Lambrecht
4,371,745 A 2/1983 Sakashita
4,384,944 A 5/1983 Silver et al.
4,387,316 A 6/1983 Katsekas
4,401,920 A 8/1983 Taylor et al.
4,403,163 A 9/1983 Rarmerding et al.
4,404,486 A 9/1983 Keim et al.
4,411,710 A 10/1983 Mochizuki et al.
4,421,284 A 12/1983 Pan
4,425,521 A 1/1984 Rosenberry, Jr. et al.
4,426,771 A 1/1984 Wang et al.
4,429,244 A 1/1984 Nikiten et al.
4,431,960 A 2/1984 Zucker
4,432,029 A 2/1984 Lundqvist
4,437,464 A 3/1984 Crow
4,443,725 A 4/1984 Derderian et al.
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,484,106 A 11/1984 Taylor et al.
4,488,079 A 12/1984 Dailey et al.
4,490,651 A 12/1984 Taylor et al.
4,503,284 A 3/1985 Minnick et al.
4,508,251 A 4/1985 Harada et al.
4,510,077 A 4/1985 Elton
4,517,471 A 5/1985 Sachs
4,520,287 A 5/1985 Wang et al.
4,523,249 A 6/1985 Arimoto
4,538,131 A 8/1985 Baier et al.
4,546,210 A 10/1985 Akiba et al.
4,551,780 A 11/1985 Canay
4,557,038 A 12/1985 Wcislo et al.
4,560,896 A 12/1985 Vogt et al.
4,565,929 A 1/1986 Baskin et al.
4,571,453 A 2/1986 Takaoka et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,615,778 A 10/1986 Elton
4,618,795 A 10/1986 Cooper et al.
4,619,040 A 10/1986 Wang et al.
4,622,116 A 11/1986 Elton et al.
4,633,109 A 12/1986 Feigel
4,650,924 A 3/1987 Kauffman et al.
4,652,963 A 3/1987 Fahlen
4,656,379 A 4/1987 McCarty
4,677,328 A 6/1987 Kumakura
4,687,882 A 8/1987 Stone et al.
4,692,731 A 9/1987 Osinga
4,723,083 A 2/1988 Elton
4,723,104 A 2/1988 Rohatyn
4,724,345 A 2/1988 Elton et al.
4,732,412 A 3/1988 van der Linden et al.
4,737,704 A 4/1988 Kalinnikov et al.
4,745,314 A 5/1988 Nakano
4,761,602 A 8/1988 Leibovich
4,766,365 A 8/1988 Bolduc et al.
4,771,168 A 9/1988 Gundersen et al.
4,785,138 A 11/1988 Breitenbach et al.
4,795,933 A 1/1989 Sakai
4,827,172 A 5/1989 Kobayashi
4,845,308 A 7/1989 Womack, Jr. et al.
4,847,747 A 7/1989 Abbondanti
4,853,565 A 8/1989 Elton et al.
4,859,810 A 8/1989 Cloetens et al.
4,859,989 A 8/1989 McPherson
4,860,430 A 8/1989 Raschbichler et al.
4,864,266 A 9/1989 Feather et al.
4,883,230 A 11/1989 Lindstrom
4,890,040 A 12/1989 Gundersen
4,894,284 A 1/1990 Yamanouchi et al.
4,914,386 A 4/1990 Zocholl
4,918,347 A 4/1990 Takaba
4,918,835 A 4/1990 Raschbichler et al.
4,924,342 A 5/1990 Lee
4,926,079 A 5/1990 Niemela et al.
4,942,326 A 7/1990 Butler, III et al.
4,949,001 A 8/1990 Campbell
4,982,147 A 1/1991 Lauw
4,994,952 A 2/1991 Silva et al.
4,997,995 A 3/1991 Simmons et al.
5,012,125 A 4/1991 Conway
5,030,813 A 7/1991 Stanisz
5,036,165 A 7/1991 Elton et al.
5,036,238 A 7/1991 Tajima
5,066,881 A 11/1991 Elton et al.
5,067,046 A * 11/1991 Elton et al. ..... 361/220
5,083,360 A 1/1992 Valencic et al.
5,086,246 A 2/1992 Dymond et al.
5,091,609 A 2/1992 Sawada et al.
5,094,703 A 3/1992 Takaoka et al.
5,095,175 A 3/1992 Yoshida et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.
5,168,662 A 12/1992 Nakamura et al.
5,171,941 A 12/1992 Shimizu et al.
5,182,537 A 1/1993 Thuis
5,187,428 A 2/1993 Hutchison et al.
5,231,249 A 7/1993 Kimura et al.
5,235,488 A 8/1993 Koch
5,246,783 A 9/1993 Spenadel et al.
5,264,778 A 11/1993 Kimmel et al.
5,287,262 A 2/1994 Klein
5,304,883 A 4/1994 Denk
5,305,961 A 4/1994 Errard et al.
5,321,308 A 6/1994 Johncock

| | | | |
|---|---|---|---|
| 5,323,330 | A | 6/1994 | Asplund et al. |
| 5,325,008 | A | 6/1994 | Grant |
| 5,325,259 | A | 6/1994 | Paulsson |
| 5,327,637 | A | 7/1994 | Breitenbach et al. |
| 5,341,281 | A | 8/1994 | Skibinski |
| 5,343,139 | A | 8/1994 | Gyugyi et al. |
| 5,355,046 | A | 10/1994 | Weigelt |
| 5,365,132 | A | 11/1994 | Hann et al. |
| 5,387,890 | A | 2/1995 | Estop et al. |
| 5,397,513 | A | 3/1995 | Steketee, Jr. |
| 5,399,941 | A | 3/1995 | Grothaus et al. |
| 5,400,005 | A | 3/1995 | Bobry |
| 5,408,169 | A | 4/1995 | Jeanneret |
| 5,449,861 | A | 9/1995 | Fujino et al. |
| 5,452,170 | A | 9/1995 | Ohde et al. |
| 5,468,916 | A | 11/1995 | Litenas et al. |
| 5,499,178 | A | 3/1996 | Mohan |
| 5,500,632 | A | 3/1996 | Halser, III |
| 5,510,942 | A | 4/1996 | Bock et al. |
| 5,530,307 | A | 6/1996 | Horst |
| 5,533,658 | A | 7/1996 | Benedict et al. |
| 5,534,754 | A | 7/1996 | Poumey |
| 5,545,853 | A | 8/1996 | Hildreth |
| 5,550,410 | A | 8/1996 | Titus |
| 5,583,387 | A | 12/1996 | Takeuchi et al. |
| 5,587,126 | A | 12/1996 | Steketee, Jr. |
| 5,598,137 | A | 1/1997 | Alber et al. |
| 5,607,320 | A | 3/1997 | Wright |
| 5,612,510 | A | 3/1997 | Hildreth |
| 5,663,605 | A | 9/1997 | Evans et al. |
| 5,672,926 | A | 9/1997 | Brandes et al. |
| 5,689,223 | A | 11/1997 | Demarmels et al. |
| 5,807,447 | A | 9/1998 | Forrest |
| 5,834,699 | A | 11/1998 | Buck et al. |

FOREIGN PATENT DOCUMENTS

| | | |
|---|---|---|
| CH | 657482 | 8/1986 |
| CH | 1189322 | 10/1986 |
| DE | 40414 | 8/1887 |
| DE | 277012 | 7/1914 |
| DE | 386561 | 12/1923 |
| DE | 387973 | 1/1924 |
| DE | 406371 | 11/1924 |
| DE | 425551 | 2/1926 |
| DE | 432169 | 7/1926 |
| DE | 433749 | 9/1926 |
| DE | 435608 | 10/1926 |
| DE | 435609 | 10/1926 |
| DE | 441717 | 3/1927 |
| DE | 443011 | 4/1927 |
| DE | 460124 | 5/1928 |
| DE | 482506 | 9/1929 |
| DE | 501181 | 7/1930 |
| DE | 523047 | 4/1931 |
| DE | 568508 | 1/1933 |
| DE | 572030 | 3/1933 |
| DE | 584639 | 9/1933 |
| DE | 586121 | 10/1933 |
| DE | 604972 | 11/1934 |
| DE | 629301 | 4/1936 |
| DE | 673545 | 3/1939 |
| DE | 719009 | 3/1942 |
| DE | 846583 | 8/1952 |
| DE | 875227 | 4/1953 |
| DE | 975999 | 1/1963 |
| DE | 1465719 | 5/1969 |
| DE | 1807391 | 5/1970 |
| DE | 2050674 | 5/1971 |
| DE | 1638176 | 6/1971 |
| DE | 2155371 | 5/1973 |
| DE | 2400698 | 7/1975 |
| DE | 2520511 | 11/1976 |
| DE | 2656389 | 6/1978 |
| DE | 2721905 | 11/1978 |
| DE | 137164 | 8/1979 |
| DE | 138840 | 11/1979 |
| DE | 2824951 | 12/1979 |
| DE | 2835386 | 2/1980 |
| DE | 2839517 | 3/1980 |
| DE | 2854520 | 6/1980 |
| DE | 3009102 | 9/1980 |
| DE | 2913697 | 10/1980 |
| DE | 2920478 | 12/1980 |
| DE | 3028777 | 3/1981 |
| DE | 2939004 | 4/1981 |
| DE | 3006382 | 8/1981 |
| DE | 3008818 | 9/1981 |
| DE | 209313 | 4/1984 |
| DE | 3305225 | 8/1984 |
| DE | 3309051 | 9/1984 |
| DE | 3441311 | 5/1986 |
| DE | 3543106 | 6/1987 |
| DE | 2917717 | 8/1987 |
| DE | 3612112 | 10/1987 |
| DE | 3726346 | 2/1989 |
| DE | 3925337 | 2/1991 |
| DE | 4023903 | 11/1991 |
| DE | 4022476 | 1/1992 |
| DE | 4233558 | 3/1994 |
| DE | 4402184 | 8/1995 |
| DE | 4409794 | 8/1995 |
| DE | 4412761 | 10/1995 |
| DE | 4420322 | 12/1995 |
| DE | 19620906 | 1/1996 |
| DE | 4438186 | 5/1996 |
| DE | 19020222 | 3/1997 |
| DE | 19547229 | 6/1997 |
| DE | 468827 | 7/1997 |
| DE | 134022 | 12/2001 |
| EP | 049104 | 4/1982 |
| EP | 0493704 | 4/1982 |
| EP | 078908 | 5/1983 |
| EP | 0120154 | 10/1984 |
| EP | 0130124 | 1/1985 |
| EP | 0142813 | 5/1985 |
| EP | 0155405 | 9/1985 |
| EP | 0102513 | 1/1986 |
| EP | 0174783 | 3/1986 |
| EP | 0185788 | 7/1986 |
| EP | 0277358 | 8/1986 |
| EP | 0234521 | 9/1987 |
| EP | 0244069 | 11/1987 |
| EP | 0246377 | 11/1987 |
| EP | 0265868 | 5/1988 |
| EP | 0274691 | 7/1988 |
| EP | 0280759 | 9/1988 |
| EP | 0282876 | 9/1988 |
| EP | 0309096 | 3/1989 |
| EP | 0314860 | 5/1989 |
| EP | 0316911 | 5/1989 |
| EP | 0317248 | 5/1989 |
| EP | 0335430 | 10/1989 |
| EP | 0342554 | 11/1989 |
| EP | 0221404 | 5/1990 |
| EP | 0375101 | 6/1990 |
| EP | 0406437 | 1/1991 |
| EP | 0439410 | 7/1991 |
| EP | 0440865 | 8/1991 |
| EP | 0469155 A1 | 2/1992 |
| EP | 0490705 | 6/1992 |
| EP | 0503817 | 9/1992 |
| EP | 0571155 | 11/1993 |

| | | | |
|---|---|---|---|
| EP | 0620570 | | 10/1994 |
| EP | 0620630 | | 10/1994 |
| EP | 0642027 | | 3/1995 |
| EP | 0671632 | | 9/1995 |
| EP | 0676777 | | 10/1995 |
| EP | 0677915 | | 10/1995 |
| EP | 0684679 | | 11/1995 |
| EP | 0684682 | | 11/1995 |
| EP | 0695019 | | 1/1996 |
| EP | 0732787 | | 9/1996 |
| EP | 0738034 | | 10/1996 |
| EP | 0739087 | A2 | 10/1996 |
| EP | 0740315 | | 10/1996 |
| EP | 0749190 | A2 | 12/1996 |
| EP | 0751605 | | 1/1997 |
| EP | 0739087 | A3 | 3/1997 |
| EP | 0749193 | A3 | 3/1997 |
| EP | 0780926 | | 6/1997 |
| EP | 0802542 | | 10/1997 |
| EP | 0913912 | A1 | 5/1999 |
| FR | 805544 | | 4/1936 |
| FR | 841351 | | 1/1938 |
| FR | 847899 | | 12/1938 |
| FR | 916959 | | 12/1946 |
| FR | 1011924 | | 4/1949 |
| FR | 1126975 | | 3/1955 |
| FR | 1238795 | | 7/1959 |
| FR | 2108171 | | 5/1972 |
| FR | 2251938 | | 6/1975 |
| FR | 2305879 | | 10/1976 |
| FR | 2376542 | | 7/1978 |
| FR | 2467502 | | 4/1981 |
| FR | 2481531 | | 10/1981 |
| FR | 2556146 | | 6/1985 |
| FR | 2594271 | | 8/1987 |
| FR | 2708157 | | 1/1995 |
| GB | 123906 | | 3/1919 |
| GB | 268271 | | 3/1927 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 666883 | | 2/1952 |
| GB | 685416 | | 1/1953 |
| GB | 715226 | | 9/1954 |
| GB | 723457 | | 2/1955 |
| GB | 739962 | | 11/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 5/1965 |
| GB | 1024583 | | 3/1966 |
| GB | 1053337 | | 12/1966 |
| GB | 1059123 | | 2/1967 |
| GB | 1103098 | | 2/1968 |
| GB | 1103099 | | 2/1968 |
| GB | 1117401 | | 6/1968 |
| GB | 1135242 | | 12/1968 |
| GB | 1157885 | | 7/1969 |
| GB | 1174659 | | 12/1969 |
| GB | 1236082 | | 6/1971 |
| GB | 1268770 | | 3/1972 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 2000625 | | 1/1979 |
| GB | 1548633 | | 7/1979 |
| GB | 2046142 | | 11/1979 |
| GB | 2022327 | | 12/1979 |
| GB | 2025150 | | 1/1980 |
| GB | 2034101 | | 5/1980 |
| GB | 1574796 | | 9/1980 |
| GB | 2070470 | | 9/1981 |
| GB | 2071433 | | 9/1981 |
| GB | 2081523 | | 2/1982 |
| GB | 2099635 | | 12/1982 |
| GB | 2105925 | | 3/1983 |
| GB | 2106306 | | 4/1983 |
| GB | 2106721 | | 4/1983 |
| GB | 2136214 | | 9/1984 |
| GB | 2140195 | | 11/1984 |
| GB | 2150153 | | 6/1985 |
| GB | 2268337 | | 1/1994 |
| GB | 2273819 | | 6/1994 |
| GB | 2283133 | | 4/1995 |
| GB | 2289992 | | 12/1995 |
| GB | 2308490 | | 6/1997 |
| GB | 2332557 | | 6/1999 |
| HU | 175494 | | 11/1981 |
| JP | 60206121 | | 3/1959 |
| JP | 57043529 | | 8/1980 |
| JP | 57126117 | | 5/1982 |
| JP | 59076156 | | 10/1982 |
| JP | 59159642 | | 2/1983 |
| JP | 6264964 | | 9/1985 |
| JP | 1129737 | | 5/1989 |
| JP | 62320631 | | 6/1989 |
| JP | 2017474 | | 1/1990 |
| JP | 3245748 | | 2/1990 |
| JP | 4179107 | | 11/1990 |
| JP | 318253 | | 1/1991 |
| JP | 3-240211 | * | 10/1991 |
| JP | 424909 | | 1/1992 |
| JP | 5290947 | | 4/1992 |
| JP | 6196343 | | 12/1992 |
| JP | 6233442 | | 2/1993 |
| JP | 6325629 | | 5/1993 |
| JP | 7057951 | | 8/1993 |
| JP | 7264789 | | 3/1994 |
| JP | 8167332 | | 12/1994 |
| JP | 07-94355 | | 4/1995 |
| JP | 7161270 | | 6/1995 |
| JP | 8264039 | | 11/1995 |
| JP | 9200989 | | 1/1996 |
| JP | 8036952 | | 2/1996 |
| JP | 8167360 | | 6/1996 |
| LU | 67199 | | 3/1972 |
| SE | 90308 | | 9/1937 |
| SE | 305899 | | 11/1968 |
| SE | 255156 | | 2/1969 |
| SE | 341428 | | 12/1971 |
| SE | 453236 | | 1/1982 |
| SE | 457792 | | 6/1987 |
| SE | 502417 | | 12/1993 |
| SU | 792302 | | 1/1971 |
| SU | 425268 | | 9/1974 |
| SU | 1019553 | | 1/1980 |
| SU | 694939 | | 1/1982 |

| | | |
|---|---|---|
| SU | 955369 | 8/1983 |
| SU | 1511810 | 5/1987 |
| WO | WO8202617 | 8/1982 |
| WO | WO8502302 | 5/1985 |
| WO | WO9011389 | 10/1990 |
| WO | WO9012409 | 10/1990 |
| WO | PCT/DE 90/00279 | 11/1990 |
| WO | WO9101059 | 1/1991 |
| WO | WO9101585 | 2/1991 |
| WO | WO9107807 | 3/1991 |
| WO | PCT SE 91/00077 | 4/1991 |
| WO | WO9109442 | 6/1991 |
| WO | WO 91/11841 | 8/1991 |
| WO | WO8115862 | 10/1991 |
| WO | WO 91/15755 | 10/1991 |
| WO | WO9201328 | 1/1992 |
| WO | WO9321681 | 10/1993 |
| WO | WO9406194 | 3/1994 |
| WO | WO9518058 | 7/1995 |
| WO | WO9522153 | 8/1995 |
| WO | WO9524049 | 9/1995 |
| WO | WO9622606 | 7/1996 |
| WO | PCT/CN 96/00010 | 10/1996 |
| WO | WO9630144 | 10/1996 |
| WO | WO9710640 | 3/1997 |
| WO | WO9711831 | 4/1997 |
| WO | WO9716881 | 5/1997 |
| WO | WO 97/29494 | 8/1997 |
| WO | WO9745288 | 12/1997 |
| WO | WO9745847 | 12/1997 |
| WO | WO 97/45908 | 12/1997 |
| WO | PCT/FR 98/00468 | 6/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834315 | 8/1998 |
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO9834331 | 8/1998 |
| WO | WO 98/40627 | 9/1998 |
| WO | WO98/40627 | 9/1998 |
| WO | WO 98/43336 | 10/1998 |
| WO | WO9917309 | 4/1999 |
| WO | WO9917311 | 4/1999 |
| WO | WO9917312 | 4/1999 |
| WO | WO9917313 | 4/1999 |
| WO | WO9917314 | 4/1999 |
| WO | WO9917315 | 4/1999 |
| WO | WO9917316 | 4/1999 |
| WO | WO9917422 | 4/1999 |
| WO | WO9917424 | 4/1999 |
| WO | WO9917425 | 4/1999 |
| WO | WO9917426 | 4/1999 |
| WO | WO9917427 | 4/1999 |
| WO | WO9917428 | 4/1999 |
| WO | WO9917429 | 4/1999 |
| WO | WO9917432 | 4/1999 |
| WO | WO9917433 | 4/1999 |
| WO | WO9919963 | 4/1999 |
| WO | WO9919969 | 4/1999 |
| WO | WO9919970 | 4/1999 |
| WO | PCT/SE 98/02148 | 6/1999 |
| WO | WO9927546 | 6/1999 |
| WO | WO9928919 | 6/1999 |
| WO | WO9928921 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |
| WO | WO9928931 | 6/1999 |
| WO | WO9928934 | 6/1999 |
| WO | WO9928994 | 6/1999 |
| WO | WO9929005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO9929024 | 6/1999 |
| WO | WO9929026 | 6/1999 |
| WO | WO9929029 | 6/1999 |
| WO | WO9929034 | 6/1999 |

OTHER PUBLICATIONS

The Skagerrak transmission—the world's longest HVDC submarine cable link; L. Haglof et al of ASEA; ASEA Journal vol. 53, No. 1–2, 1980, pp 3–12, no month.

Direct Connection of Generators to HVDC Converters: Main Characteristics and Comparative Advantages; J.Arrillaga et al; *Electra* No. 149, Aug. 1993, pp 19–37, no date.

Our flexible friend article; M. Judge; *New Scientist*, May 10, 1997, pp 44–48.

In–Service Performance of HVDC Converter transformers and oil–cooled smoothing reactors: G.L. Desilets et al; *Electa* No. 155, Aug. 1994, pp. 7–29, no date.

Transformateurs a courant continu haute tension–examen des specifications; A. Lindroth et al; *Electra* No. 141, Apr. 1992, pp 34–39, no date.

Development of a Termination for the 77 kV–Class High Tc Superconducting Power Cable; T. Shimonosono et al; IEEE Power Delivery, vol. 12, No. 1, Jan. 1997, pp 33–38, no date.

Verification of Limiter Performance in Modern Excitation Control Systems; G. K. Girgis et al; IEEE Energy Conservation, vol. 10, No. 3, Sep. 1995, pp 538–542, no date.

A High Initial response Brushless Excitation System; T. L. Dillman et al; IEEE Power Generation Winter Meeting Proceedings, Jan. 31, 1971, pp 2089–2094.

Design, manufacturing and cold test of a superconducting coil and its cryostat for SMES applications; A. Bautista et al; IEEE Applied Superconductivity, vol. 7, No. 2, Jun. 1997, pp 853–856, no date.

Quench Protection and Stagnant Normal Zones in a Large Cryostable SMES; Y. Lvovsky et al; IEEE Applied Superconductivity, vol. 7, No. 2, Jun 1997, pp 857–860, no date.

Design and Construction of the 4 Tesla Background Coil for the Navy SMES Cable Test Apparatus; D.W.Scherbarth et al; IEEE Appliel Superconductivity, vol. 7, No. 2, Jun. 1997, pp 840–843, no date.
High Speed Synchronous Motors Adjustable Speed Drives; ASEA Generation Pamphlet OG 135–101 E, Jan. 1985, pp 1–4, no date.
Billig burk motar overtonen; A. Felldin; *ERA* (TEKNIK) Aug. 1994, pp 26–28, no date.
400–kV XLPE cable system passes CIGRE test; ABB Article; ABB Review Sep. 1995, pp 38, no date.
FREQSYN—a new drive system for high power applications;J–A. Bergman et al; ASEA Journal 59, Apr. 1986, pp16–19, no date.
Canadians Create Conductive Concrete; J. Beaudoin et al; *Science*, vol. 276, May 23, 1997, pp 1201.
Fully Water–Cooled 190 MVA Generators in the Tonstad Hydroelectric Power Station; E. Ostby et al; BBC Review Aug. 1969, pp 380–385, no date.
Relocatable static var compensators help control unbundled power flows; R. C. Knight et al; *Transmission & Distribution*, Dec. 1996, pp 49–54, no date.
Investigaton and Use of Asynchronized Machines in Power Systems*; N.I.Blotskii et al; *Elekrichestvo*, No. 12, 1–6, 1985, pp 90–99, no month.
Variable–speed switched reluctance motors; P.J. Lawrenson et al; IEE proc, vol. 127, Pt.B, No. 4, Jul. 1980, pp 253–265, no date.
Das Einphasenwechselstromsystem hoherer Frequenz; J.G. Heft; Elektrische Bahnen eb; Dec. 1987, pp 388–389, no date.
Power Transmission by Direct Current;E. Uhlmann;ISBN 3–540–07122–9 Springer–Verlag, Berlin/Heidelberg/New York; 1975, pp 327–328, no month.
Elektriska Maskiner; F. Gustavson; Institute for Elkreafteknilk, KTH; Stockholm, 1996, pp 3–6—3–12, no month.
Die Wechselstromtechnik; A Cour Springer Verlag, Germany; 1936, pp 586–598, no month.
Insulation systems for superconducting transmission cables; O. Toennesen; Nordic Insulation Symposium, Bergen, 1996, pp 425–432, no month.
MPTC: An economical alternative to universal power flow controllers;N. Mohan; EPE 1997, Trondheim, pp 3.1027–3.1030, no month.
Lexikon der Technik; Luger; Band 2, Grundlagen der Elektrotechnik und Kerntechnik, 1960, pp 395, no month.
Das Handbuch der Lokomotiven (hungarian locomotive V40 1 D); B. Hollingsworth et al; Pawlak Verlagsgesellschaft; 1933, pp. 254–255, no month.
Synchronous machines with single or double 3–phase star–connected winding fed by 12–pulse load commutated inverter. Simulation of operational behaviour, C. Ivarson et al; ICEM 1994, International Conference on electrical machines, vol. 1, pp 267–272, no month.
Elkrafthandboken, Elmaskiner; A. Rejminger; Elkrafthandboken, Elmaskiner 1996, 15–20, no month.
Power Electronics—in Theory and Practice; K. Thorborg; ISBN 0–86238–341–2, 1993, pp 1–13, no month.
Regulating transformers in power systems—new concepts and applications; E. Wirth et al; ABB Review Apr. 1997, p 12–20, no date.
Tranforming transformers; S. Mehta et al; *IEEE Spectrum*, Jul. 1997, pp. 43–49, no date.
A study of equipment sizes and constraints for a unified power flow controller, J. Bian et al; IEEE Transactions on Power Delivery, vol. 12, No. 3, Jul. 1997, pp. 1385–1391, no date.
Industrial High Voltage; F.H. Kreuger; *Industrial High Voltage* 1991 vol. 1, pp. 113–117, no month.
Hochspannungstechnik; A Küchler; Hochspannungstechnik, VDI Verlag 1996, pp. 365–366, ISBN 3–18–401530–0 or 3–540–62070–2, no month.
High Voltage Engineering; N.S. Naidu; High Voltage Engineering, second edition 1995 ISBN 0–07–462286–2, Chapter 5, pp91–98, no month.
Performance Characteristics of a Wide Range Induction Type Frequency Converter; G.A. Ghoneem; Ieema Journal, Sep. 1995, pp 21–34, no month.
International Electrotechnical Vocabulary, Chapter 551 Power Electronics;unknown author, International Electrotechnical Vocabulary Chapter 551: Power Electronics Bureau Central de la Commission Electrotechnique Internationale, Geneve; 1982, pp1–65, no month.
Design and manufacture of a large superconducting homopolar motor; A.D. Appleton; IEEE Transactions on Magnetics, vol. 19,No. 3, Part 2, May 1983, pp 1048–1050, no date.
Application of high temperature superconductivy to electric motor design; J.S. Edmonds et al; IEEE Transactions on Energy Conversion Jun. 1992, No. 2, pp 322–329, no date.
Power Electronics and Variable Frequency Drives; B. Bimal; IEEE industrial Electronics—Technology and Applications, 1996, pp. 356, no month.
Properties of High Plymer Cement Mortar; M. Tamai et al; *Science & Technology in Japan, No. 63*; 1977, pp 6–14, no month.
Weatherability of Polymer–Modified Mortars after Ten–Year Outdoor Exposure in Koriyama and Sapporo; Y. Ohama et al; *Science & Technology in Japan No. 63*; 1977, pp 26–31, no month.
SMC Powders Open New Magnetic Applications; M. Persson (Editor); *SMC Update*, vol. 1, No. 1, Apr. 1997, no date.
Characteristics of a laser triggered spark gap using air, Ar, Ch4,H2, He, N2, SF6 and Xe; W.D. Kimura et al; Journal of Applied Physics, vol. 63, No. 6, Mar. 15, 1988, p. 1882–1888.
Low–intensy laser–triggering of rail–gaps with magnesium–aerosol switching–gases; W. Frey; 11th International Pulse Power Conference, 1997, Baltimore, USA Digest of Technical Papers, p. 322–327, no month.
Shipboard Electrical Insulation; G. L. Moses, 1951, pp2&3, no mont.
Elkraft teknisk Handbok, 2 Elmaskiner; A. Alfredsson et al; 1988, pp 121–123, no month.
High Voltage Cables in a New Class of Generators Powerformer; M. Leijon et al; Jun. 14, 1999; pp1–8.
Ohne Tranformator direkt ins Netz; Owman et al, ABB, AB; Feb. 8, 1999; pp48–51.
High Voltage Generators; G. Beschastnov et al; 1977; vol. 48. No. 6 pp 1–7, no month.
Eine neue Type von Unterwassermotoren; Electrotechnik und Maschinenbam, 49; Aug. 1931; pp2–3.
Problems in design of the 110–5OokV high–voltage generators; Nikiti et al; World Electrotechnical Congress; Jun. 21–27, 1977; Section 1. Paper #18.
Manufacture and Testing of Roebel bars: P. Marti et al; 1960; Pub.86, vol. 8, pp 25–31, no month.

Hydroalternators of 110 to 220 kV Elektotechn. Obz., vol. 64, No. 3, pp132–136 Mar. 1975; A. Abramov, no month.
Design Concepts for an Amorphous Metal Distribution Transformer, E. Boyd et al; IEEE 11/84, no date.
Neue Wege zum Bau zweipoliger Turbogeneratoren bis 2 GVA, 6OkV Elektrotechnik und Maschinenbau Wien Janner 1972, Heft 1, Seite 1–11; G. Aichholzer, no month.
Optimizing designs of water–resistant magnet wire; V. Kuzenev et al; Elektrotekhnika, vol. 59, No. 12, pp35–40, 1988, no month.
Direct Generation of alternating current at high volatages; R. Parsons; 4/29 IEEE Journal, vol. 67 #393, pp1065–1080, no date.
Stopfbachslose Umwalzpumpen– ein wichtiges Element im modernen Kraftwerkbau; H. Holz, KSB 1, pp13–19, 1960, no month.
Zur Geschichte der Brown Boveri–Synchron–Masc, Vfetz Generatorbau; Jan.–Feb. 1931 pp15–39, no month.
High capacity synchronous generator having no tooth satic, V.S. Kildishev et al; No. 1, 1977 pp11–16, no month.
Der Asynchronmotor als Antrieb stopfbcichsloser Pumpen; E. Picmaus; Eletrotechnik und Maschinenbay No. 78, pp153–155, 1961, no month.
Low core loss rotating flux transformer, R. F. Krause, et al; American Institute Physics J.Appl.Phys vol. 64 #10 Nov. 1988, pp5376–5378, no date.
Hochspannungsaniagen for Wechselstrom; 97. Hochspannungsaufgaben an Generatoren und Motoren; Roth et al; Spring 1959, pp30–33, no month.
Neue Lbsungswege zum Entwurf grosser Turbogeneratoren bis 2GVA, 6OkV; G. Aicholzer, Sep. 1974, pp249–255, no date.
Advanced Turbine–generators—an assessment; A. Appleton, et al; International Conf. Proceedings, Lg HV Elec. Sys. Paris, FR, Aug.–Sep./1976, vol. I, Section 11–02, p. 1–9, no date.
Fully slotless turbogenerators; E. Spooner; Proc., IEEE vol. 120 #12, Dec. 1973, no date.
Toroidal winding geometry for high voltage superconducting alternators; J. Kirtley et al; MIT—Elec. Power Sys. Engrg. Lab for IEEE PES 2/74, no date.
High–Voltage Stator Winding Development; D. Albright et al; Proj. Report EL339, Project 1716, Apr. 1984, no date.
POWERFORMER™: A giant step in power plant engineering; Owman et al; CIGRE 1998, Paper 11:1.1, no month.
Thin Type DC/DC Converter using a coreless wire transformer; K. Onda et al; Proc. IEEE Power Electronics Spec. Conf. 6/94, pp330–334, no date.
Transformer core losses: B. Richardson; Proc. IEEE May 1986, pp365–368.
Cloth–transformer with divided windings and tension annealed amorphous wire; T. Yammamoto et al; IEEE Translation Journal on Magnetics in Japan vol. 4, No. 9 Sep. 1989, no date.
A study of equipment sizes and constraints for a unified power flow controller; J Bian et al; IEEE 1996, no month.

* cited by examiner

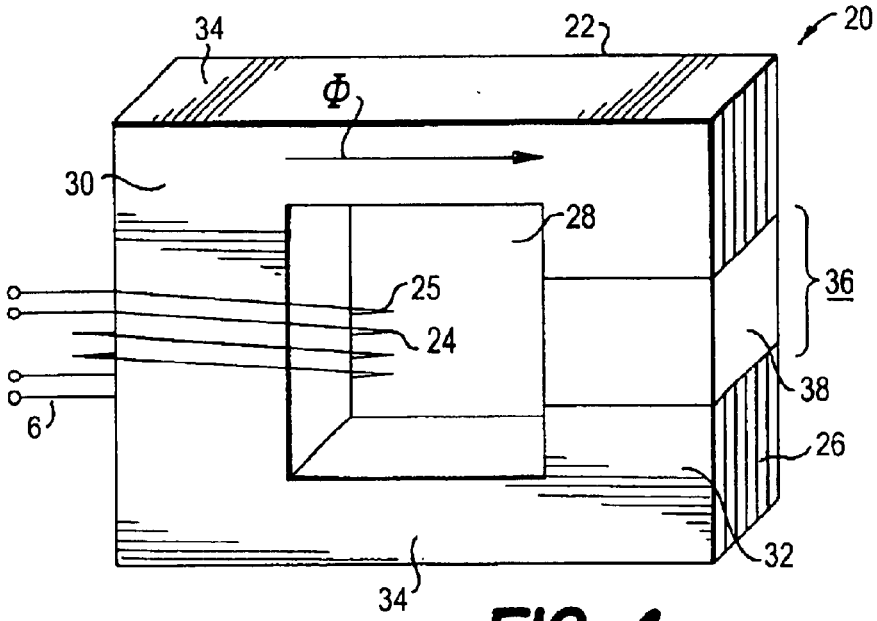
FIG. 4
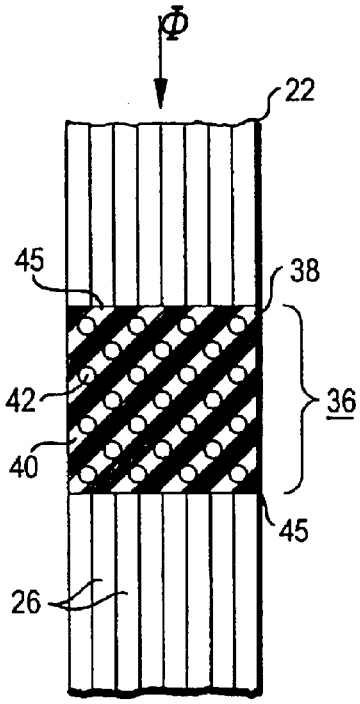
FIG. 5
FIG. 12
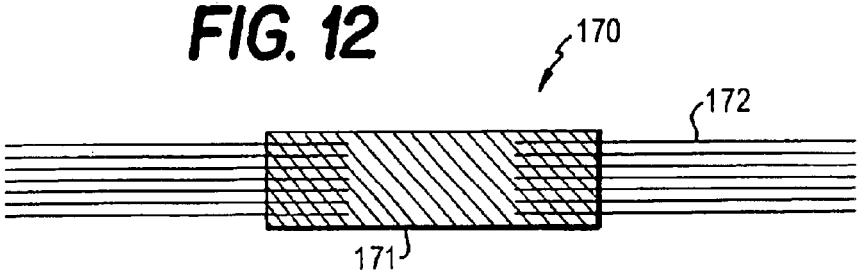

INDUCTION DEVICES WITH DISTRIBUTED AIR GAPS

CROSS-REFERENCE TO RELATED APPLICATIONS

This application is a continuation application of the parent application Ser. No. 09/537,748, filed Mar. 30, 2000 now abandoned.

BACKGROUND OF THE INVENTION

The present invention relates to induction devices and particularly to relatively large devices used for power generating and utilization having one or more distributed air gaps formed in the core. The distributed air gap is generally in the form of a magnetic particulate material in a matrix of dielectric material which can comprise a gas or a liquid or a solid or a semi-solid material or combinations thereof.

Induction devices such as reactors are used in power systems, for example, in order to compensate for the Ferranti effect from long overhead lines or extended cable systems causing high voltages in the open circuit or lightly loaded lines. Reactors are sometimes required to provide stability to long line systems. They may also be used for voltage control and switched into and out of the system during light load conditions. In a like manner, transformers are used in power systems to step up and step down voltages to useful levels.

Such devices are manufactured from similar components. Typically, one or more coils are wrapped around a laminated core to form windings, which may be coupled to the line or load and switched in and out of the circuit in a desirable manner. The equivalent magnetic circuit of a static inductive device comprises a source of magnetomotive force, which is a function of the number turns of the winding, in series with the reluctance of the core, which may include iron and, if provided, an air gap. While the air gap is not strictly speaking necessary, reactors and transformers without air gaps tend to saturate at high magnetic field densities. Thus, control is less precise and fault currents may produce catastrophic failures.

The core, shown in fragmentary form in FIG. 13, may be visualized as a body having a closed magnetic circuit, for example, a pair of legs and interconnecting yokes. One of the legs may be cut through to form the air gap. The core may support the windings which, when energized by a current, produces a magnetic field $\phi$ in the core, which extends across the air gap. At high current densities the magnetic field is intense.

Although useful and desirable, the gap represents a weak link in the structure of the core. The core tends to vibrate at a frequency twice that of the alternating input current. This is the source of vibrational noise and stress in such devices.

Another problem associated with the air gap is that the field $\phi$ fringes, spreads out and is less confined. Thus, field lines tend to enter and leave the core with a non-zero component transverse to the core laminations which can cause a concentration in unwanted eddy currents and hot spots in the core.

These problems are somewhat alleviated by the use of one or more inserts in the gap designed to stabilize the structure and thereby reduce vibrations. In addition, the structure, or insert, is formed of materials which are designed to reduce the fringing effects in the gap. However, these devices are difficult to manufacture and are expensive.

An article by Arthur W. Kelley and F. Peter Symonds of North Carolina State University entitled "Plastic-Iron-Powder-Distributed-Air-Gap Magnetic Material" discusses both discrete and distributed air gap inductor core technology as well as using fine metal powder in the making of specific shaped parts, such as air gap magnetic materials and also for use in making radar absorbing materials.

In the Kelley paper, the magnetic permeability is fixed and specific throughout the various applications disclosed. The present invention is directed to an air gap insert having a transitional zone wherein the magnetic permeability is at some intermediate value less than that of the core itself and greater than that of the air gap material itself.

The solutions presented in the Kelley article would only apply in the field of high frequency, low current signal handling and would not necessarily work in the field of high power, low frequency electronics.

The use of high power, low frequency inductors with air gaps have various problems associated with huge mechanical forces across the air gap as well as noise and vibration of the electrical devices. Such devices are also prone to energy losses and overheating in adjacent cores due to flux fringing. These problems are associated with high power, low frequency devices in part due to their large physical structure, something that is not present in the power electronic devices discussed in Kelley. Therefore, the solutions to these problems require very different solutions than those used to address the smaller devices of the power electronics field.

A typical insert comprises a cylindrical segment of radially laminated core steel plates arranged in a wedge shaped pattern. The laminated segments are molded in an epoxy resin as a solid piece or module. Ceramic spacers are placed on the surface of the module to space it from the core, or when multiple modules are used, from an adjacent module. In the latter case, the modules, and ceramic spacers are accurately stacked and cemented together to make a solid core limb for the device.

The magnetic field in the core creates pulsating forces across all air gaps which, in the case of devices used in power systems, can amount to hundreds of kilo-newtons (kN). The core must be stiff to eliminate these objectionable vibrations. The radial laminations in the modules reduce fringing flux entering flat surfaces of core steel which thereby reduce current overheating and hot spots.

These structures are difficult to build and require precise alignment of a number of specially designed laminated wedge shaped pieces to form the circular module. The machining must be precise and the ceramic spacers are likewise difficult to size and position accurately. As a result, such devices are relatively expensive. Accordingly, it is desirable to produce an air gap spacer which is of unitary construction and substantially less expensive than the described prior arrangements.

SUMMARY OF THE INVENTION

The present invention is based upon the discovery that a distributed air gap insert or region may be provided for an inductor in a power system in which the insert comprises magnetic particles in a matrix of a dielectric material which magnetic particles have a particle size and volume fraction sufficient to provide an air gap with reduced fringe effects. The dielectric may be a gas, or a liquid, or a solid or a semi-solid or combinations thereof.

In one form, the distributed air gap comprises an integral body shaped to conform to the air gap dimensions.

In another embodiment, the magnetic material is formed in a matrix of an organic polymer.

Alternatively, the magnetic particles may be coated with a dielectric material.

In another embodiment, the distributed air gap comprises a dielectric container filled with magnetic particles in a matrix of dielectric material. The container may be flexible.

In yet another form, the core is formed of one or more turns of a magnetic wire or ribbon or a body formed by powder metallurgy techniques.

Still yet another embodiment of the invention sets forth the air gap as having a transition zone of magnetic permeability.

All or part of the core may be in the form of a distributed air gap. Also, the density of the particles forming the distributed air gap may be varied by application of a force thereon to regulate the reluctance of the device.

In an exemplary embodiment, the particulate material has a particle size of about 1 nm to about 1 mm, preferably about 0.1 micrometer ($\mu$m) to about 200 micrometer ($\mu$m), and a volume fraction of up to about 60%. The magnetic permeability of the power material is about 1–20. The magnetic permeability may be adjusted by about 2–4 times by applying a variable isotropic compression force on the flexible container.

BRIEF DESCRIPTION OF THE DRAWINGS

The invention will now be described with reference to the accompanying drawings, wherein

FIG. 4 is a schematic perspective view of a high power inductive device having a distributed air gap in accordance with an exemplary embodiment of the invention;

FIG. 5 is a fragmentary cross section of an embodiment of the distributed air gap according to the invention;

FIG. 12 is a cross-sectional view of a portion of a magnetic circuit having a transition zone with more than one value of magnetic permeability.

DESCRIPTION OF THE INVENTION

Figure 1:
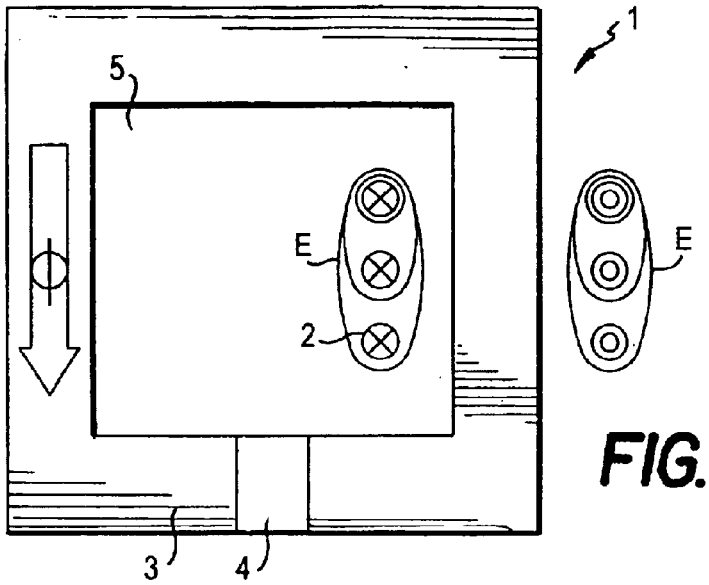
FIG. 1 shows the electric field distribution around a winding of a inductive device for a power transformer or reactor having a distributed air gap according to the invention.

The present invention will now be described in greater detail with reference to the accompanying drawings. FIG. 1 shows a simplified view of the electric field distribution around a winding of a induction device such as a power transformer or reactor 1 which includes one or more windings 2 and a core 3. Equipotential lines E show where the electric field has the same magnitude. The lower part of the winding is assumed to be an earth potential. The core 3 has a distributed air gap 4 according to the invention and a window 5. The core may be formed of a laminated sheet of magnetically permeable material, e.g. silicon steel, or may be formed of magnetic wire, ribbon or powder metallurgy material. The direction of the flux $\phi$ is shown by the arrow. In general, the flux $\phi$ confined or nearly confined within the core 3 is uninterrupted as shown.

The potential distribution determines the composition of the insulation system, especially in high power systems, because it is necessary to have sufficient insulation both between adjacent turns of the winding and between each turn and hearth. In FIG. 1, the upper part of the winding is subjected to the highest dielectric stress. The design and location of a winding relative to the core 3 are in this way determined substantially by the electric field distribution in the core window 5. The windings Z may be formed of a conventional multi-turn insulated wire, as shown, or the windings Z may be in the form of a high power transmission line cable discussed below. In the former case, the device may be operated at power levels typical for such devices in known power generating systems. In the latter case, the device may be operated at much high power levels not typical for such devices.

Figure 2:
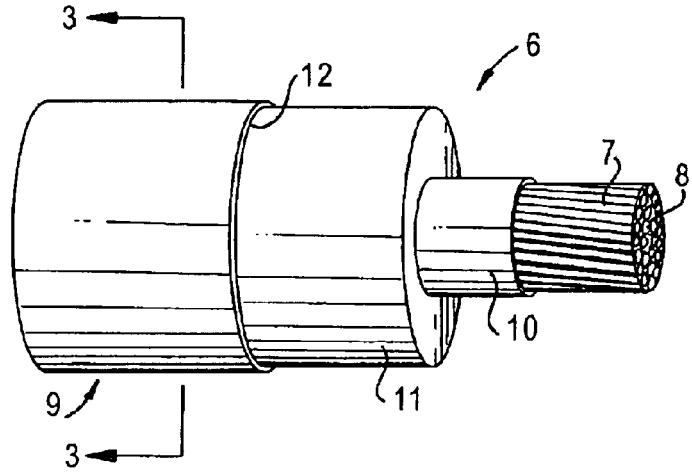
FIG. 2 is a perspective fragmentary view of a cable which may be used in the winding of a high power static inductive device for a power system according to an exemplary embodiment to the invention.
Figure 3:
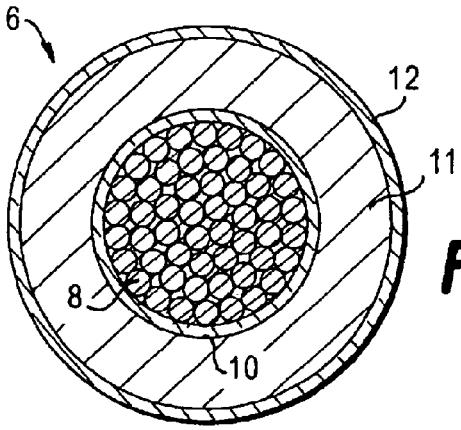
FIG. 3 is a cross section of the cable shown in FIG. 2.

FIGS. 2 and 3 illustrate an exemplary cable 6 for manufacturing windings Z useful in high voltage, high current and high power inductive devices in accordance with an embodiment of the invention. Such cable 6 comprises at least one conductor 7 which may include a number of strands 8 with a cover 9 surrounding the conductor 7. In the exemplary embodiment, the cover 9 includes a semiconducting layer 10 disposed around the strands 8. A solid main insulating layer 11 surrounds the inner semiconducting layer 10. An outer semiconducting layer 12 surrounds the main insulating layer 11 as shown. The inner and outer layers 10 and 12 have a similar coefficient of thermal expansion as the main insulation layer 11. The cable 6 may be provided with additional layers (not shown) for special purposes. In a high power static conductor device in accordance with the invention, the cable 6 may have a conductor area which is between about 30 and 3000 $mm^2$ and the outer cable diameter may be between about 20 and 250 millimeters. Depending upon the application, the individual strands 8 may be individually insulated. A small number of the strands near the interface between the conductor 7 and the inner semiconducting layer 10 may be uninsulated for establishing good electrical contact therewith.

Devices for use in high power application, manufactured in accordance with the present invention may have a power ranging from 10 KVA up to over 1000 MVA, with a greater voltage ranging from about 34 kV and up to a very high transmission voltages, such as 400 kV to 800 kV or higher.

The conductor 7 is arranged so that it has electrical contact with the inner semiconducting layer 10. As a result, no harmful potential differences arise in the boundary layer between the innermost part of the solid insulation and the surrounding inner semiconducting layer along the length of the conductor.

The similar thermal properties of the various layers, results in a structure which may be integrated so that semiconducting layers in the adjoining insulation layer exhibit good contact independently of variations and temperatures which arise in different parts of the cable. The insulating layer and the semiconducting layers form a monolithic structure and defects caused by different temperature expansion of the insulation and the surrounding layers do not arise.

The outer semiconducting layer is designed to act as a static shield. Losses due to induced voltages may be reduced by increasing the resistance of the outer layer. Since the thickness of the semiconducting layer cannot be reduced below a certain minimum thickness, the resistance can mainly be increased by selecting a material for the layer having a higher resistivity. However, if the resistivity of the semiconducting outer layer is too great the voltage potential between adjacent, spaced apart points at a controlled, e.g. earth, potential will become sufficiently high as to risk the occurrence of corona discharge with consequent erosion of the insulating and semiconducting layers. The outer semiconducting layer is therefor a compromise between a conductor having low resistance and high induced voltage losses but which is easily held at a desired controlled electric potential, e.g. earth potential, and an insulator which has high resistance with low induced voltage losses but which is difficult to hold at the controlled electric potential along its length. Thus, the resistivity ρ, of the outermost semiconducting layer should be within the range $\rho_{min}<\rho_s<\rho_{max}$, where $\rho_{min}$ is determined by permissible power loss caused by eddy current losses and resistive losses caused by voltages induced by magnetic flux and $\rho_{max}$ is determined by the requirement for no corona or glow discharge. Preferably, but not exclusively, $\rho_s$ is between 10 and 100 Ωcm.

The inner semiconducting layer 10 exhibits sufficient electric conductivity in order for it to function in a potential equalized manner and hence equalizing with respect to the electric field outside the inner layer. In this connection, the inner layer 10 has such properties that any irregularities in the surface of the conductor 7 are equalized, and the inner layer 10 forms an equipotential surface with a high surface finish at the boundary layer with the solid insulation 11. The inner layer 10 may, as such, be formed of a varying thickness but to insure an even surface with respect to the conductor 7 and the solid insulation 11, its thickness is generally between 0.5 and 1 millimeter.

Referring to FIG. 4, there is shown a simplified view of an exemplary induction device 20 according to an exemplary embodiment of the invention, including a core 22 and at least one winding 24 having N turns. The core 22 is in the form of a rectangular body which may be formed of insulated laminated sheet 26 having a window 28. The core may also be formed of a magnetically permeable ribbon, wire or a powder metallurgy substance. The core 22 has limbs or legs 30 and 32 joined by opposite yoke portions 34. The winding 24 may, for example be wrapped around the solid leg or limb 30. Limb 32 is formed with a gap 36 and a relatively high reluctance distributed air gap insert 38 is located in the air gap as shown.

The arrangement of FIG. 4 may also operate as a transformer when the second winding 25 is employed. As illustrated, the winding 25 may be wound around the core 22. In the arrangement illustrated, the winding 25 is wound concentrically with the winding 24.

In accordance with the invention, the core limb 32 exhibits a relatively high reluctance to the flux ϕ produced when either of the windings 24–25 are energized. The insert 38 acts as a distributed air gap and is generally non-saturated thereby allowing the device 20 to act as a controller or transformer device in a variety of power applications.

FIG. 5 illustrates the distributed air gap insert 38 in fragmentary schematic cross-section. The insert 38 may comprise a matrix of dielectric material 40 containing magnetically permeable particles 42.

The dielectric 40 may be an epoxy resin, polyester, polyamide, polyethylene, cross-linked polyethylene, PTFE (polytetrafluoroethylene) and PFA (polyperflouroalkoxyethylene or pheno-formaldehyde) sold under the trademark Teflon by Dupont, rubber, EPR (ethylene propylene rubber), ABS (acrylonitrile-butadiene-styrene), polyacetal, polycarbonate, PMMA (poly methyl methaacrylate), polyphenylene sulphone, PPS (polyphenylene sulphide), PSU (polysulphone), polysulfone, polyetherimid PEI (polyetherimide), PEEK (polyetheretherketone), and the like. As discussed in greater detail with respect to FIG. 8, the dielectric material 40 may also coat the particles 42. The magnetic particles 42 may be formed of iron, amorphous iron based materials, Ni—Fe alloys, Co—Fe alloys, Mn—Zn, Ni—Zn, Mn—Mg and the like.

In the exemplary embodiment shown in FIG. 5, opposing faces 45 of the air gap 36 and the corresponding confronting surfaces 45 of the insert 38 may be formed with planar or curvilener confronting surfaces. The insert 38 may have convex surfaces and the confronting surfaces 45 of the core may be concave to stabilize the structure mechanically. Alternatively, the surfaces 45 of the core may be concave and the surface of the insert may be convex to modify field fringing. Generally however, the arrangement illustrated, the flux ϕ in the core 22 tends to be better confined within the distributed air gap insert or region 38. This occurs because the particles 42 provide an insulated magnetic path through the insert 38 for the flux ϕ which tends to minimize fringing effects at the interfaces 45 and thereby reduce eddy currents in the core 22 and the insert 38.

Figure 6A:
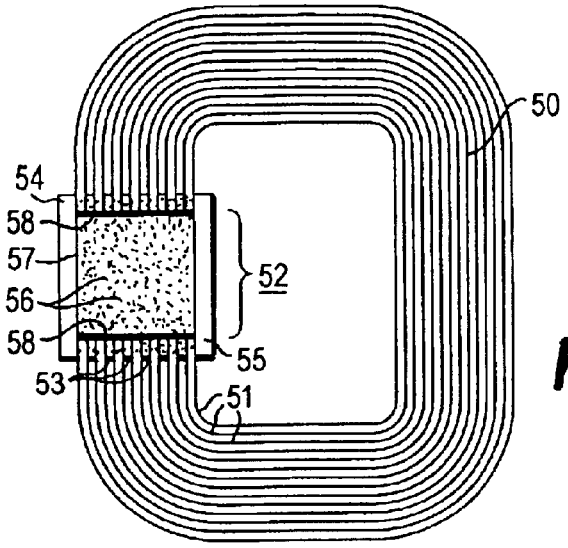
FIG. 6A is a side sectional view of another embodiment of the invention employing a dielectric container filled with magnetic particles in a matrix of dielectric material.

FIG. 6A shows another embodiment of the invention in which a core 50 formed of a magnetic wire or laminations 51 has an air gap 52 and employs a distributed air gap insert 54 comprising a dielectric container 55 filled with magnetic powder particles 56 in a dielectric matrix 57 or coated magnetic particles as described hereinafter. The core 50 may comprise a spirally wound magnetic wire, as shown, or a ribbon of magnetic material, or a powder metallurgy material as discussed hereinafter. The core 50 has opposed confronting free ends or surfaces 58 imbedded in the powder forming an interface with the insert 54. The free ends 58 may be irregular or jagged to create a better transition zone in the interface where the permeability gradually changes from the core 50 to the air gap insert 54. In the embodiment shown, ends 53 of the laminations 51 at the interface may be alternatively off set to create the irregular or jagged end 58.

Figure 6B:
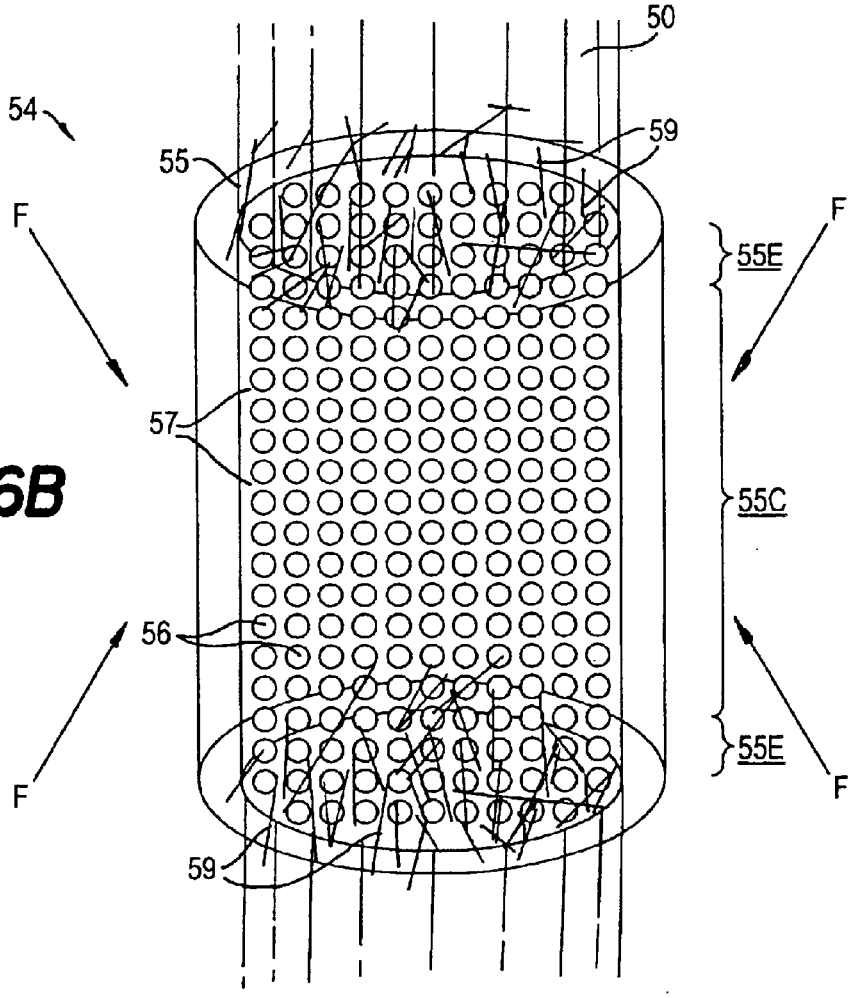
FIG. 6B is a fragmentary perspective view of an alternative embodiment of the distributed air gap in FIG. 6A employing chopped magnetic wire in the end portions thereof.

Alternately, as shown in FIG. 6B, the insert 54 may have a multi-component structure in which the central portion 55C is filled with the magnetic particles 56 in the matrix of dielectric material 57, and the end portions 55E are filled with short lengths of chopped magnetic wire 59, and which may exist without the dielectric matrix 57 as desired, to provide good electrical contact with the core 50 and a smooth magnetic transition into and out of the air gap insert 54. The interface may be planar or curved as desired.

The air gap inserts shown in FIGS. 6A and 6B exemplify an embodiment of the invention wherein there is provided a magnetic circuit having transition zones wherein there exits more than one value for magnetic permeability. That is, a zone within the air gap material wherein the magnetic permeability values may vary such as with the lower permeability values of the air gap material and greater permeability values for the core. With such transition zones, the inductor can have portions of the air gap material that have an intermediate permeability value that is greater than the permeability value of other portions of the air gap material itself and less than the permeability value of the core. For example, in FIG. 6A, in the magnetic circuit the core 50 has a permeability value, the confronting free ends or surfaces 58 embedded in the powder 56 have a permeability value and the air gap insert 54 has a permeability value. In the exemplary embodiment, the permeability value of the core 50 is greater than the permeability value of the confronting surfaces 58 and the permeability value of the confronting surfaces 58 is greater than the permeability value of the air gap insert 54. This difference in permeability values of the separate regions forms the transition zone between the core 50 and the air gap insert 54.

Another example that illustrates this concept of a transition zone more clearly is shown in FIG. 6B wherein the central portion 55C of the air gap insert 54 has a permeability value that is less than the permeability value of the end portions 55E containing the chopped wire 59, which is less than the permeability value of the core 50. The graduated increase in permeability values from the central portion 55C of the air gap insert 54 to the core 50 creates the transition zone of permeability within the magnetic circuit.

In the arrangement illustrated in FIG. 6A, it is possible to vary the reluctance of the distributed air gap 54 by imposing a pressure or force on the flexible container 55 to thereby change the density of the particles 56 therein (FIG. 6B). The force F is typically isotropic or evenly distributed so that the change in the reluctance is uniform and predictable. In the embodiment illustrated, the change in reluctance is about a factor of about 2–4 times. The change in the particle density may be employed in other various embodiments discussed herein.

Figure 7:
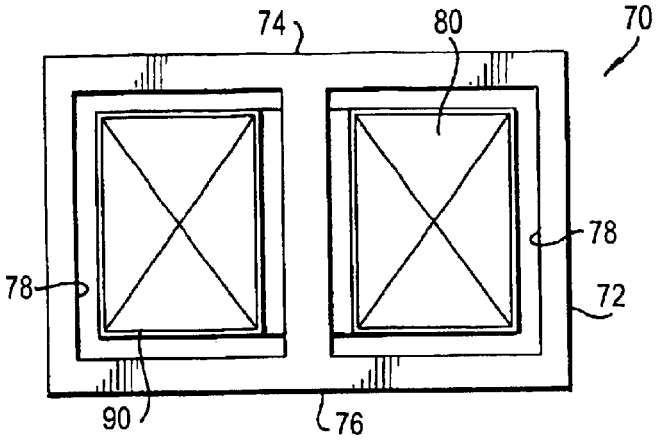
FIG. 7 is a schematic view of an inductor formed with a powder metallurgy frame and distributed air gap.

Another method to achieve a distributed air gap employs coated magnetic particles in a static inductive device 70 as illustrated in FIG. 7 including a core frame 72 having air gap 74 and distributed air gap insert 76. The device 70 has windows 78 and at least one winding 80 shown schematically. As in each of the arrangements described, the winding 80 may be an insulated coated wire or a cable as above described.

Figure 8:
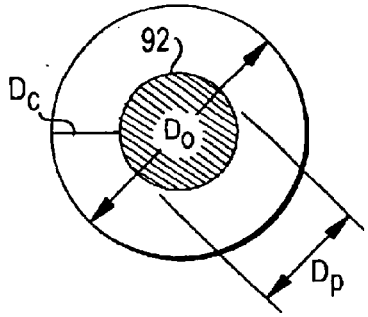
FIG. 8 is a schematic illustration of a powder particle for the distributed air gap.

The distributed air gap insert 76 is formed of powder particles 90 comprising magnetic particles 92 surrounded by dielectric matrix coating 94 (FIG. 8). The powder particles 90 have an overall diameter $D_0$, a particle diameter $D_p$, and a coating thickness $D_c$ as shown. The insert 76 may be formed or shaped as shown by molding, hot isostatic pressing the particles 90 or other suitable methods. For example, the matrix may be sintered, if the sintering process does not destroy the dielectric properties of the coating.

As noted above, particles, as coated, have an outer diameter $D_0$, and a coating thickness $D_c$. The electric resistivity and magnetic permeability are factors to consider when determining the ratio $D_c/D_0$. The resistivity is to reduce eddy currents and the permeability is to determine the reluctance of the gap.

Alternatively, the coated particles 90 may be used to fill a container, hose or pipe as noted above. If the magnetic particles 92 have sufficient resistivity, they may be used alone without a coating and may further be combined with a gas, liquid, solid or semisolid dielectric matrix.

Figure 9A:
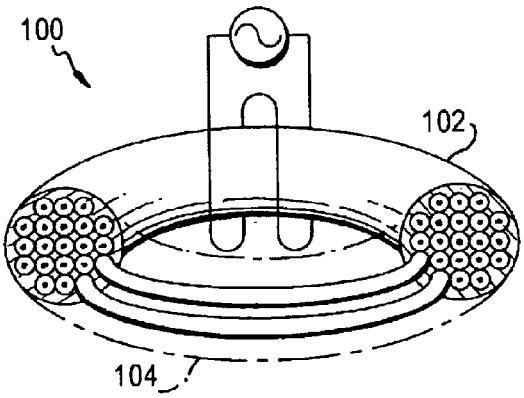
FIG. 9A is a fragmentary sectional view of a core formed of one or more turns of a dielectric tube containing magnetic particles in a matrix of dielectric material.
Figure 9B:
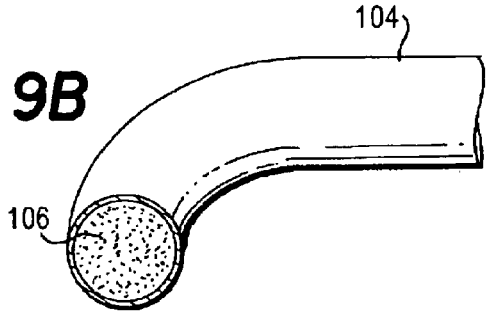
FIG. 9B is a fragmentary detail of an embodiment of the invention employing a tube filled with magnetic particles in dielectric matrix.

FIGS. 9A & 9B illustrate a static inductive device 100 having a core 102 in the form of a torus wound hose 104 having a hollow interior filled with magnetic powder 106 similar to the arrangement described above with respect to FIG. 6A. It should be understood that the core in FIG. 9A may also be manufactured from a magnetic wire or ribbon.

Figure 9C:
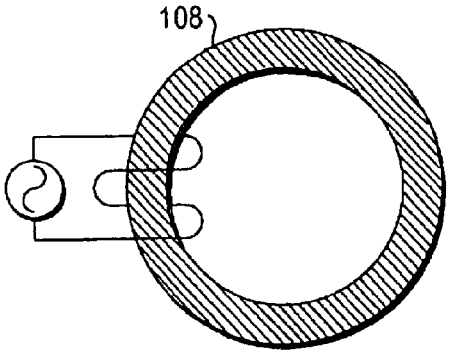
FIGS. 9C–9E are schematic illustrations of cores having distributed air gaps according to the invention.
Figure 9D:
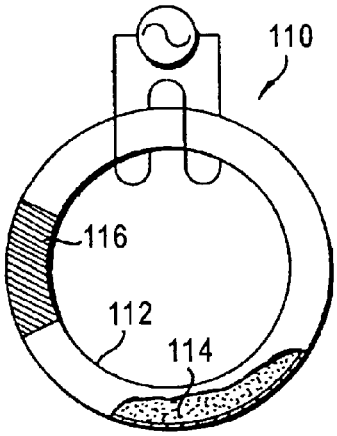

In the arrangement shown in FIG. 9C, if the entire core 102 is a filled hose, the entire core is thus a distributed air gap. Also, as shown in FIG. 9D, core 110 may be in the form of wound hose segments 112 filled with magnetic particles 114 (FIG. 9F). The insert 116 shown in FIGS. 9D & 9F may be formed of hose segments 118 filled with magnetic particles 120 in a dielectric matrix or coated magnetic particles discussed in greater detail hereinafter.

Figure 9E:
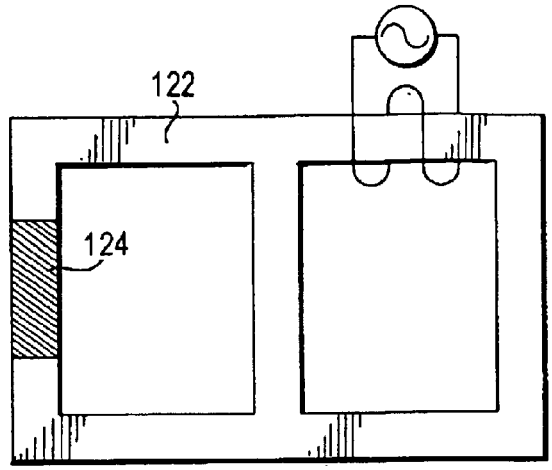
Figure 9F:
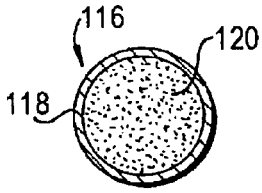
FIG. 9F is a sectional view of core portions which form the distributed air gaps of the inductor.
Figure 13:
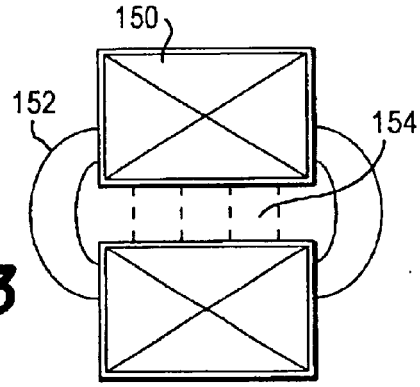
FIG. 13 is a fragmentary view of a conventional air gap.

FIG. 9E shows a rectangular core 122 which may be formed as herein described as a full distributed air gap or with an insert 124 as shown. Although similar to the arrangement of FIG. 4, the arrangements of FIGS. 9A–9F have a different geometry. The dielectric material of FIG. 4 is solid, whereas in FIGS. 9A–9F magnetic particles may be distributed in a fluid dielectric such as air.

Figure 10:
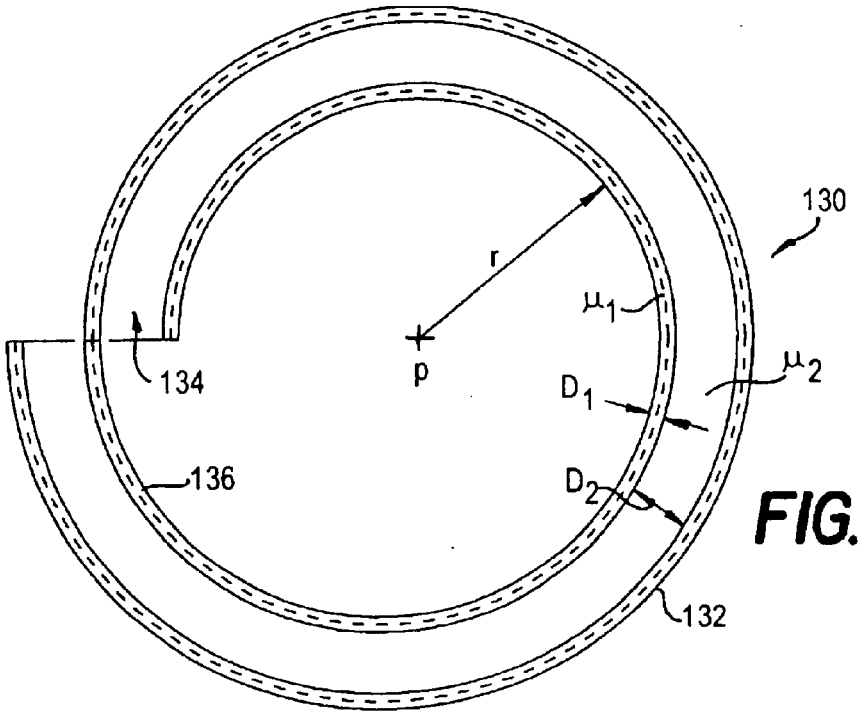
FIG. 10 is a schematic illustration of one turn of an exemplary core forming a distributed air gap.

In the embodiment of FIG. 10, the exemplary core 130 may be in the form of a roll 132 having a radius r of ribbon, wire or a hose of thickness D1. The hose may be filled with magnetic powder or dielectric coated magnetic powder as described. The roll 132 is wound like a spiral, as shown, in a low permeability material, for example air $\mu_2$ with a layer of separation or spacing 124 having a thickness D2 therebetween. The dimensions are exaggerated for clarity.

An induced magnetic flux $\phi$ having a value well below the saturation in the roll direction forms a typical flux line 136 in the form of a closed loop. For a single spiral roll, any flux line 136 passing the region of high permeability 132 has to pass the region of low permeability 134 exactly once in order to close on itself. Assuming small enough ratio of $\mu_2/\mu_1$, the part of the flux line 136 crossing the layer of separation or space 134 will be nearly perpendicular to the roll direction and with a length slightly greater than the distance D2. The total reluctance seen by the flux line 136 crossing a section of width D1+D2 at a distance r>>D1, D2 from the center point P is given approximately by the sum of the reluctance in the core in the roll direction and the total reluctance across the layer of separation 134. As follows:

R is approximately equal to $C(L/(\mu_1/D1)+(D2/L\ \mu_2))$ $L=2\ \pi r$,

C is a constant

Figure 11A:
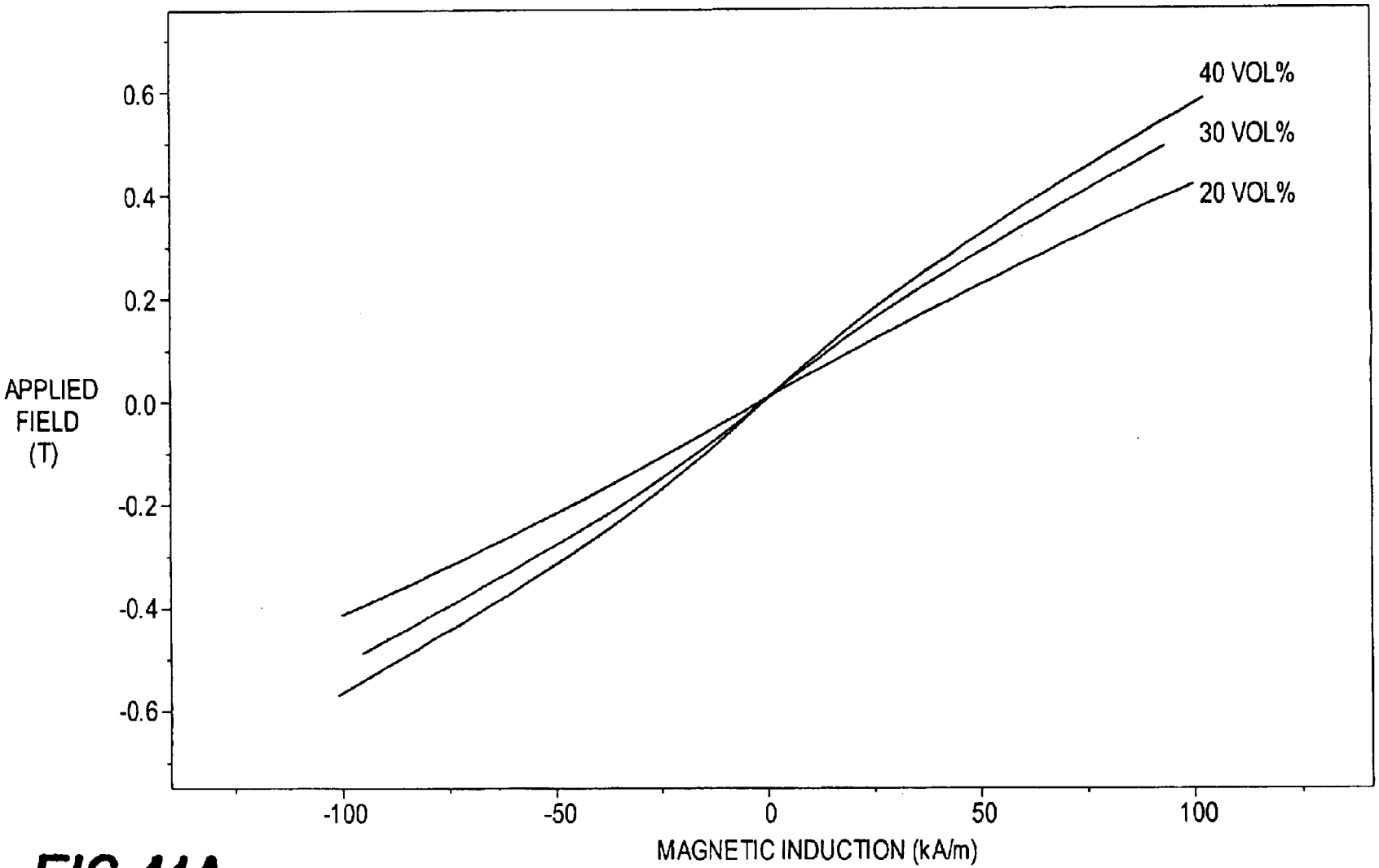
FIGS. 11A & 11B are exemplary diagrams showing hystenesis and power loss for various volume fractions of magnetically permeable particles, e.g. iron.
Figure 11B:
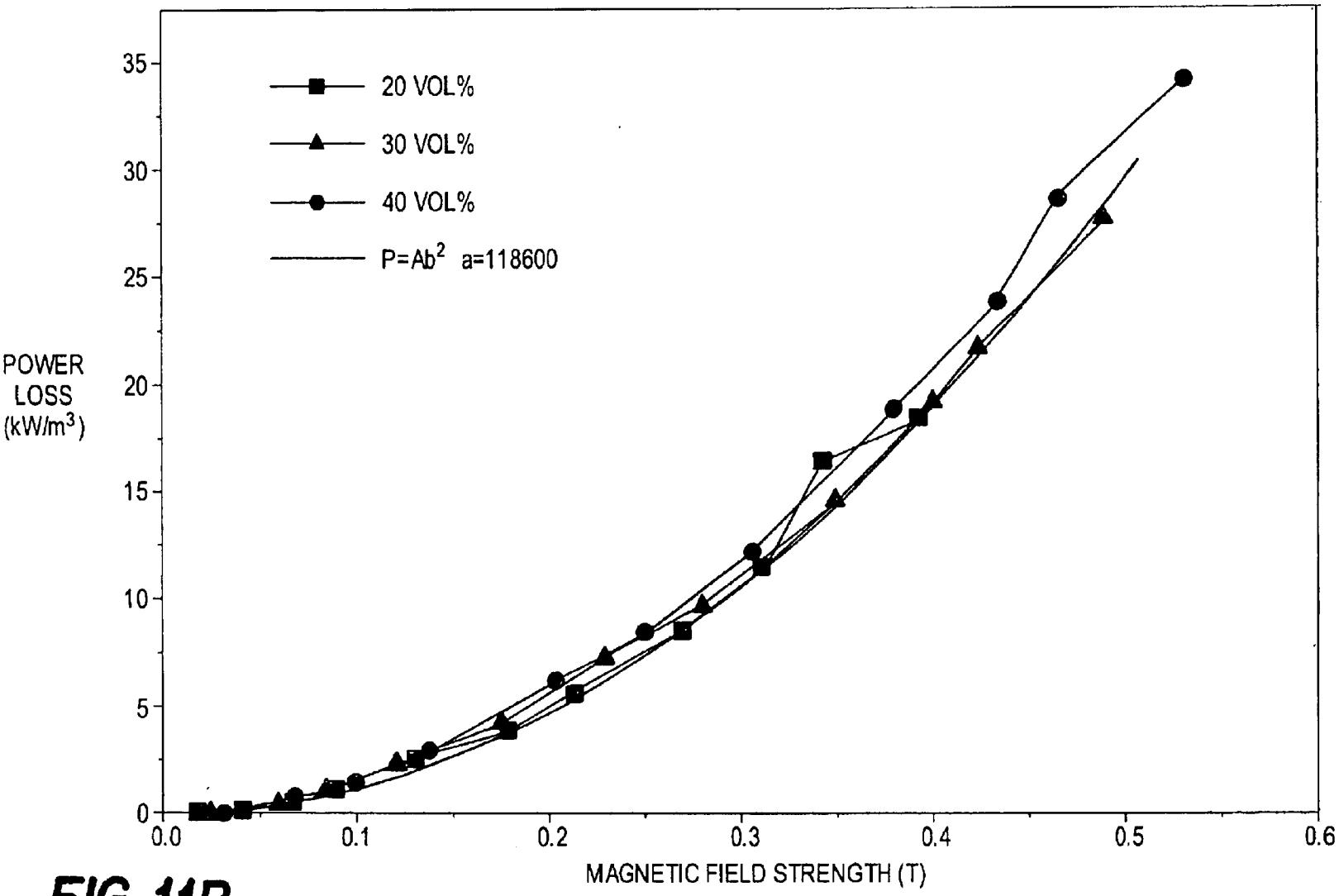

FIG. 11A illustrates the magnetic induction H and the applied field B for various magnetic particles. FIG. 11B shows the relationship of the magnetic field strength B to the power loss P for various particle volume fractions densities.

FIG. 12 shows a part 170 of a magnetic circuit having a section with wires 172 inserted part way into a piece of distributed air gap material 171 resulting in a transition zone having more than one value of magnetic permeability in the distributed air gap material 171. The distribution of the wires 172 within the distributed air gap material 171 create a graduated permeability in the air gap material such that the permeability at some intermediate value is less than the permeability of the core and greater than the permeability of the air gap material itself.

While there has been described by the present considered to be an exemplary embodiment of the invention, it will be apparent to those skilled in that various changes and modifications may be made therein without departing therefrom.

Accordingly, it is intended in the appended claims to cover such changes and modifications as come within the true spirit and scope of the invention.

What is claimed is:

1. An induction device formed with a core having a region of reduced permeability in a selected portion thereof comprising:

a distributed air gap material disposed in the selected portion of the core; and a flexible high-voltage winding wound on the core and being configured to operate in an inclusive range of above 34 kV through a system voltage of a power network, including a current-carrying conductor formed of a plurality insulated strands and a plurality of uninsulated strands;

an inner layer having semiconducting properties surrounding and being in electrical contact with said current-carrying conductor, a solid insulating layer surrounding and contacting the inner layer, and an outer layer having semiconducting properties surrounding and contacting the solid insulating layer.

2. The induction device according to claim 1, wherein:

said core has opposed free ends forming an interface with said air gap material;

said air gap material has a magnetic permeability value;

said core has a magnetic permeability value;

said permeability value of said air gap material is less than said magnetic permeability value of said opposing free ends;

said permeability value of said opposing free ends is less than said magnetic permeability value of said core; and a transition zone formed by differences in magnetic permeability values of said air gap, said core, said air gap material and said opposing free ends.

3. The induction device according to claim 1, wherein said distributed air gap, comprises:

an air gap insert for providing reluctance in said air gap;

said air gap insert is a multi-component structure; and a transition zone in said air gap wherein said multicomponent structure of said air gap insert has more than one value of magnetic permeability.

4. The induction device according to claim 3, wherein:

said multi-component structure has a central portion and end portions.

5. The induction device according to claim 4, wherein:

said central portion has a permeability value;

said end portions have a permeability value;

said core has a permeability value;

said permeability value of said central portion is less than the permeability value of said end portions;

said permeability value of said end portion is less than said permeability value of said core; and said difference of permeability values forms said transition zone.

6. The induction device according to claim 5, wherein:

said core is comprised of at least one of:

a) a magnetic wire, b) a ribbon of magnetic material, and c) a magnetic powder metallurgy material.

7. An induction device formed with a core having a region of reduced permeability in a selected portion thereof comprising:

a distributed air gap material disposed in the selected portion of the core; and a flexible high-voltage winding wound on the core and being configured to operate in an inclusive range of above 34 kV through a system voltage of a power network, said high-voltage winding being flexible including a current-carrying conductor comprising a plurality insulated strands and a plurality of uninsulated strands, an inner layer having semiconducting properties surrounding and being in electrical contact with said current-carrying conductor, a solid insulating layer surrounding and contacting the inner layer, and an outer layer having semiconducting properties surrounding and contacting the solid insulating layer.

* * * * *